US007033741B2

(12) United States Patent
Shih et al.

(10) Patent No.: US 7,033,741 B2
(45) Date of Patent: Apr. 25, 2006

(54) METHOD OF CONVERTING A RECORDING ELEMENT

(75) Inventors: Po-Jen Shih, Webster, NY (US); Arthur M. Gooray, Penfield, NY (US); Timothy J. Wojcik, Rochester, NY (US); Hwei-Ling Yau, Rochester, NY (US); James E. Pickering, Bloomfield, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/944,569

(22) Filed: Sep. 17, 2004

(65) Prior Publication Data

US 2006/0063114 A1 Mar. 23, 2006

(51) Int. Cl.
*G03C 11/08* (2006.01)
*B41J 2/01* (2006.01)
*B41J 3/407* (2006.01)

(52) U.S. Cl. ..... 430/350; 347/102; 347/106; 428/32.5; 428/32.25

(58) Field of Classification Search ..... 430/350; 347/102, 106; 428/32.5, 32.25
See application file for complete search history.

(56) References Cited

U.S. PATENT DOCUMENTS

| | | | | |
|---|---|---|---|---|
| 4,785,313 | A | 11/1988 | Higuma et al. | |
| 4,832,984 | A | 5/1989 | Hasegawa et al. | |
| 5,824,616 | A | 10/1998 | Kagata et al. | |
| 6,114,020 | A | 9/2000 | Misuda et al. | |
| 6,120,199 | A | 9/2000 | Takekoshi | |
| 6,332,679 | B1 | 12/2001 | Higuma et al. | |
| 6,357,871 | B1 | 3/2002 | Ashida et al. | |
| 6,394,669 | B1 | 5/2002 | Janosky et al. | |
| 2002/0008747 | A1 | 1/2002 | Kaga et al. | |
| 2002/0027587 | A1 | 3/2002 | Sugaya et al. | |
| 2005/0122382 | A1* | 6/2005 | Pickering et al. | 347/104 |
| 2005/0122383 | A1* | 6/2005 | Wojcik et al. | 347/104 |

FOREIGN PATENT DOCUMENTS

| | | |
|---|---|---|
| EP | 1284186 | 2/2003 |
| JP | 2002-283553 | 3/2002 |

* cited by examiner

*Primary Examiner*—Richard L. Schilling
(74) *Attorney, Agent, or Firm*—William R. Zimmerli

(57) ABSTRACT

A method of converting a recording element is provided. The method includes providing an imaged recording element having a convertible layer, the convertible layer comprising polymeric particles and a polymeric binder, the polymeric particles having a glass transition temperature $T_{g1}$, and the polymeric binder having a glass transition temperature $T_{g2}$; heating the convertible layer to a temperature $T_p$, $T_p$ being greater than $T_{g1}$ and $T_{g2}$; and converting the heated convertible layer of the recording element by advancing the recording element through a pair of rollers, the first roller of the pair of rollers being maintained at a first temperature $T_1$ and the second roller of the pair of rollers being maintained at a second temperature $T_2$, $T_1$ and $T_2$ being less than $T_p$, the convertible layer of the recording element becoming a converted layer after advancing through the pair of rollers, wherein the converted layer has an exit temperature $T_f$, $T_f$ being less than $T_p$.

22 Claims, 7 Drawing Sheets

METHOD OF CONVERTING A RECORDING ELEMENT

CROSS REFERENCE TO RELATED APPLICATIONS

Reference is made to commonly assigned U.S. Publication No. U.S. 2005/0122383 published Jun. 9, 2005, entitled "RECORDING ELEMENT PRINTING AND TREATING SYSTEM AND METHOD", in the name of Timothy J. Wojcik, et al., and U.S. Publication No. U.S. 2005/0122382 published Jun. 9, 2005, entitled "APPARATUS AND METHOD OF TREATING A RECORDING ELEMENT", in the name of James E. Pickering, et al.

FIELD OF THE INVENTION

This invention relates generally to an apparatus and method of treating a recording element and, more particularly, to an apparatus and method of treating an imaged and/or printed recording element.

BACKGROUND OF THE INVENTION

Inkjet printing is a non-impact printing method that, in response to a digital signal, produces droplets of ink that are deposited on a recording element. Today, inkjet printing systems are used in a variety of capacities in industrial, home, and office environments. The quality of inkjet prints continues to improve, however, inkjet prints are disadvantaged because they lack durability, often being less stable relative to environmental factors (light, ozone, etc.) and more sensitive to water and abrasion.

One way of overcoming these disadvantages is to laminate or encapsulated inkjet prints. When an inkjet print is laminated, a transparent overlay is adhered to the inkjet print. Typically, this is accomplished using an adhesive activated by heat, pressure, or both. The transparent overlay physically protects the print and seals it from ingress of water. When an inkjet print is encapsulated, the print is positioned between two laminating sheets, at least one of which is transparent. Then some combination of the print and the laminating sheets are adhered usually using an adhesive activated by heat, pressure, or both. Typically, encapsulation is most effective when the laminating sheets extend beyond the print and are bonded to each other at the extremities, thus preventing ingress of water through exposed edges of the print.

Lamination and encapsulation both have disadvantages in that they are expensive processes requiring additional materials and handling by the user. Moreover, inkjet inks remained trapped within the recording element which can degrade image quality by causing stain or migration of the print on storage or exposure. Laminate materials and adhesives can often deteriorate over time causing surface defects including, for example, cracking. Laminates do not always adhere well to inkjet prints. The quality and uniformity of adhesion can depend on the material nature of the recording element, the type of ink, and the volume of ink printed per unit area of recording element (ink laydown). The latter is particularly significant when the inkjet print has photographic image quality because heavy laydowns of ink are necessary to achieve the necessary superb image quality.

As an alternative to lamination or encapsulation, inkjet recording elements having a nascent protective layer coated on a support are known. The nascent protective layer is really a special chemical layer designed such that during the inkjet printing process, the inks penetrate the layer, and after printing is complete, the layer is fused using heat and/or pressure so that it seals and protects the print. This process is often referred to as the incorporated approach because the nascent protective material is incorporated into the recording element during its production.

However, the incorporated approach is limited because it is difficult to obtain a final protected print that is uniform in gloss and clarity and free of surface defects such as blistering and cracking. Limitations are especially apparent when the final protected print must have superb image quality, e.g., when it is for photographic or medical diagnostic applications. A recording element for these applications may have one or more of these layers underlying the nascent protective layer to help manage a heavy laydown of ink. After printing, the bulk of the ink, commonly referred to as the carrier, is retained somewhere in the dual layer system. If too much carrier resides in the nascent protective layer during fusing, it will not fuse properly and any of the aforementioned undesirable effects may be observed.

This condition worsens when the carrier resides predominately in an ink-receiving layer during and/or after fusing of the nascent protective layer, and then migrates within the ink-receiving layer, or from the ink-receiving layer and into the fused protective layer. Migration of the carrier within the ink-receiving layer causes deterioration of image quality, e.g., loss of image sharpness and blotchiness, and migration into the fused protective layer causes any of the aforementioned undesirable effects.

Examples of inkjet printing methods that employs the incorporated approach are described in U.S. Pat. No. 6,114,020, issued to Misuda et al., on Sep. 5, 2000; U.S. Pat. No. 4,832,984, issued to Hasegawa et al., on May 23, 1989; and U.S. Pat. No. 4,785,313, issued to Higuma et al., on Nov. 15, 1988.

European Patent Application 1 284 186 A2 describes a fixing apparatus and an image fixing method for improving the gloss of an inkjet image recorded on an inkjet recording material. The inkjet recording material includes a porous top layer which can be thermally fixed. After the image has been printed, the recording material is held in "a suspended state" before it is passed between a pair of fixing belts or rollers that are held at some elevated temperature and pressure.

Japanese Unexamined Patent Publication 2002-283553 A describes an inkjet recording device for controlling the gloss and clarity of an image surface of a recording medium. The device includes inkjet printing means for generating a printed image on a recording medium and fixing means for heating and pressing the printed image. The recording medium has a thermoplastic resin layer that receives ink and is subsequently fixed.

U.S. Pat. No. 6,394,669 B1, issued to Janosky et al., on May 28, 2002, discloses a post-print treatment processor for a photofinishing apparatus. Printed media is transported to a post-treatment processor. The post-treatment processor stations dry the media and apply a durable material on the printed media. In preferred embodiments, drying is accomplished using infrared radiation technology and application of the durable material is accomplished by laminating a clear protective film to the imaged side of the printed media.

U.S. Patent Application Publication 2002/0027587 A1 describes an apparatus and method for forming prints. A recording medium having thermoplastic resin particles on a surface layer is printed. Subsequently the resin particles are made transparent by a heating and pressing device. U.S. Patent Application Publication 2002/0008747 A1 describes a similar method.

U.S. Pat. No. 6,357,871 B1 describes an inkjet recording medium and apparatus for preparing an inkjet printed product. The inkjet recording medium has a layer of fine particles of a thermoplastic organic polymer that are dissolved or melted after inkjet recording to form a layer wherein the particles are fused to one another. Fusing the particles involves a step of heating the layer followed by an impressing step of passing the recording medium between a pair of press rolls while the layer is still in a plastic state after the heating step.

All of the aforementioned art are disadvantaged in that the bulk of the ink, or carrier, is trapped within the recording element after the protective layer is formed which leads to the problems described above.

U.S. Pat. No. 6,332,679 B1 describes an inkjet printer used to form an image on a recording medium. The recording medium includes a porous surface layer that is flattened by simultaneously pressing and heating the layer to form a flattened layer. Pressing is carried out by passing the imaged recording medium through a nip created by a pair of rollers. The nip is defined as a nip region having a point A at which the ink solvent contained in the recording medium reaches the boiling point, and a point B at which the porous layer of the recording medium loses its liquid permeation property.

The disadvantage associated with this method and apparatus is that ink solvent removal and flattening of the layer are carried out in the same step with very little physical distance between point A and point B. Therefore, neither step can be individually optimized and/or controlled. As a result, the flexibility of the method and apparatus to accommodate a broad range of recording media and ink volume laydowns is limited to those combinations that meet the temperature, pressure and transport speed conditions of the nip region. Another problem with this method and apparatus is that in order to remove enough ink solvent the temperature of the flattening roller must be high enough in order to cause sufficient evaporation before the liquid permeation property is eliminated. If the temperature is too high, the support can deform and release of the recording medium from the flattening roller becomes problematic. Additionally, the evaporated ink solvent can condense on the flattening roller making it difficult to maintain the temperature of the flattening roller. The condensed solvent can also redeposit on the surface or the recording medium increasing the potential for image defects.

U.S. Pat. No. 6,120,199 describes an inkjet printing apparatus having a heating fixation unit and a fixing unit. The heating fixation unit includes a fan that blows heated air over the surface of an imaged recording medium in an attempt to dry the surface before it enters the fixing unit. While ink solvent is allowed to escape from the imaged recording medium, the amount of ink solvent removed cannot be adequately controlled. Therefore, the reliability of the apparatus is reduced.

Additionally, the reliability of the apparatus also depends on a clean separation of the imaged recording medium from the fixing unit in processes that involve portions of the fixing unit providing pressure and energy by directly contacting the imaged recording medium. Prior to this step of the process, a portion of the imaged recording medium is tackified by heat (heated air, for example) to form a continuous protective overcoat over the imaged recording medium. However, in the event, any portion of the tackified imaged recording medium sticks to a portion of the fixing unit, overall image quality can be reduced or cause the apparatus to jam and may even damage the fixing unit.

Several methods have been developed in order to increase the likelihood of the imaged recording medium cleanly separating from the fixing unit, especially for fixing units that incorporate rollers. For example, it is known to use a thin coating of release agents on the rollers of the fixing unit. U.S. Pat. No. 5,824,416 discloses using different types coating materials on a fixing unit. Alternatively, a releasing agent can be used in the recording medium, preferably in the outermost layer of the recording medium. Examples of such releasing agents include: waxes, such as carnauba wax, paraffin wax, micro crystalline wax and castor wax; higher fatty acids or derivatives thereof like metal salts and esters; polyamide-based resins, petroleum-based resins, rosin derivatives, coumarone-indene resins, terpene-based resins, novolak-based resins, styrene-based resins, and olefin-based resins such as polyethylene, polypropylene, polybutene, oxidated polyolefins and vinyl ether-based resins.

The overall image quality of the converted recording element is also dependent on the smoothness of the surface. One commonly used measurement to quantify the converted surface is the specular gloss that associated with the capability of a surface to reflect light in a prescribed angle. This method of measurement is described in ASTM-D523.

SUMMARY OF THE INVENTION

According to a feature of the present invention, a method of converting a recording element includes providing an imaged recording element having a convertible layer, the convertible layer comprising polymeric particles and a polymeric binder, the polymeric particles having a glass transition temperature $T_{g1}$, and the polymeric binder having a glass transition temperature $T_{g2}$; heating the convertible layer to a temperature $T_p$, $T_p$ being greater than $T_{g1}$ and $T_{g2}$; and converting the heated convertible layer of the recording element by advancing the recording element through a pair of rollers, the first roller of the pair of rollers being maintained at a first temperature $T_1$ and the second roller of the pair of rollers being maintained at a second temperature $T_2$, $T_{1\ and\ T2}$ being less than $T_p$, the convertible layer of the recording element becoming a converted layer after advancing through the pair of rollers, wherein the converted layer has an exit temperature $T_f$, $T_f$ being less than $T_p$.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Referring to FIGS. 1–7, example embodiments of the invention are shown with like components being described using like reference symbols. Although the embodiments of the invention are suited for obtaining monochrome or multicolored transparent prints typically used in medical diagnostic imaging applications, the embodiments of the inventions also find application in other areas, for example, in obtaining monochrome or multicolor reflective prints suitable for use in medical diagnostic imaging applications, photographic applications, etc.

As used herein, durability characteristic refers to any characteristic related to the preservation of an imaged recording element, or inkjet print. For example, durability characteristic refers to the stability of an inkjet print towards environmental factors such as light and ozone which can cause discoloration or fading of the imaged recording element. Other examples of durability characteristics include the stability or resistance of an inkjet print towards humidity, water, staining, and physical abrasion. The glass transition temperature refers to the temperature at which the said ink recording element transforms from a brittle (or glassy) state to a softened (or rubbery) state. In a similar fashion, the effective glass transition temperature refers to the glass transition temperature of the combined components used in the convertible layer of the recording element. Alternatively stated, the effective glass transition temperature refers to the composite effects of the components present in the convertible layer of the recording element on the glass transition temperature and is like the concept of rule of mixture.

Figure 1:
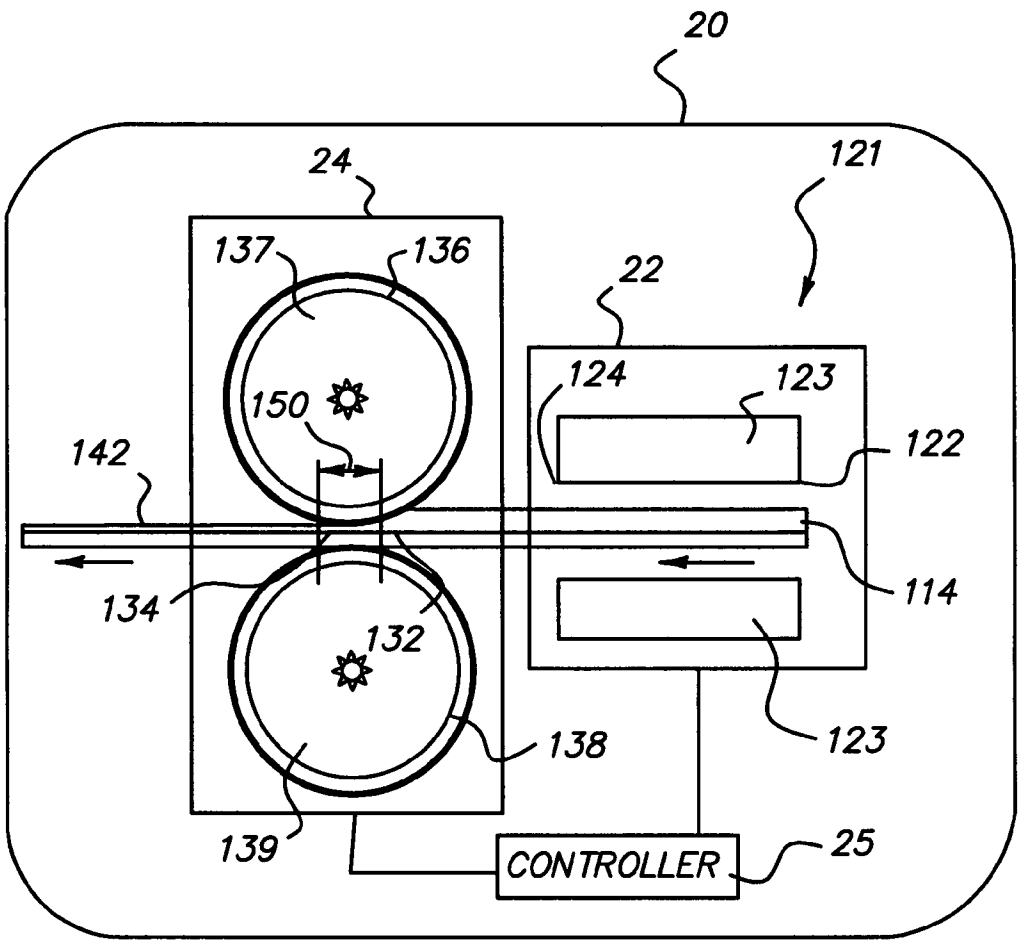
FIG. 1 is a block diagram of an apparatus made in accordance with the invention.

Referring to FIG. 1, a block diagram of a recording element treating apparatus 20 is shown. Apparatus 20 includes two stations—a carrier removal station 22 which removes carrier, typically an ink carrier, from a recording element 114 and a converting station 24 which alters (for example, increases or improves) a durability characteristic of the recording element 114. Carrier removal station 22 and converting station 24 are connected to a conventional controller 25 which allows either and/or both stations 22 and 24 to be individually controlled, programmed, and/or adjusted depending on one or more factors. These factors include, for example, media type, ink type, desired image resolution, etc. Controller 25 can include a user interface, as is known in the art, or can be of the type that adjusts operating parameters automatically based on, for example, information received from other components of the apparatus 20 and/or printing system 26 (discussed below).

Carrier removal station 22 includes a device(s) 121 that removes carrier from recording element 114. In the embodiment shown in FIG. 1, device 121 includes one or more heating elements 123, for example, halogen lamps, that produce heat causing carrier to evaporate (or be removed) from recording element 114. In addition to removing carrier from the recording element 114, device 121 also raises the temperature of a recording element 114 to a processing temperature $T_p$. In the embodiment shown in FIG. 1, carrier removal and heating are accomplished using the same device 121. However, these functions can be performed by distinct devices in alternative embodiments of the invention, for example, multiple heating elements 123 that heat recording element 114 to different temperatures, one sufficient to remove carrier, the other sufficient to raise the temperature of recording element 114 to processing temperature $T_p$. Recording element 114 moves enters carrier removal station 22 at entrance 122 and continues on to converting station 24 after leaving carrier removal station 22 through exit 124.

Converting station 24 includes a device(s) 136, 138 that alters a durability characteristic of recording element 114. Pressure roller 136 and roller 138 form a converting nip 150. Either or both of rollers 136 and/or 138 can be hollow and include a heating element 137, 139 (for example, a halogen lamp, etc.) that elevates the temperature of the converting station 24 and helps with the durability characteristic change.

In this embodiment, the set temperatures of the heated pressure rollers are lower than the processing temperature $T_p$ that is the temperature of the recording element at the entrance of the converting nip 132. Thus, the converting nip 150 takes energy away from recording element 114 as recording element 114 being converted to increase a durability characteristic of recording element 114. The temperature of the recording element 114 at the exit of the converting nip 134 is lower than the processing temperature $T_p$ and more preferably lower than the glass transition temperature of the recording element 114. As well known in the art that, at a temperature above its glass transition temperature, recording element exhibit fluid-like behavior and becomes more viscous and tacky as the temperature increases. On the other hand, exiting the converting nip 150 at a lower temperature (e.g. below the glass transition temperature of recording element 114) means that the recording element 114 is in a more solid-like state that can decrease the likelihood of recording element 114 sticking on the pressure rollers 138, 136 and yield better release performance. However, converting the recording element 114 at a lower temperature requires higher nip pressure. The relative positions of roller 136 and roller 138 are such that the pressure created and applied to recording element 114 by roller 136 and roller 138 is sufficient to increase a durability characteristic of recording element 114 as recording element 114 travels through converting nip 150.

Figure 2A:
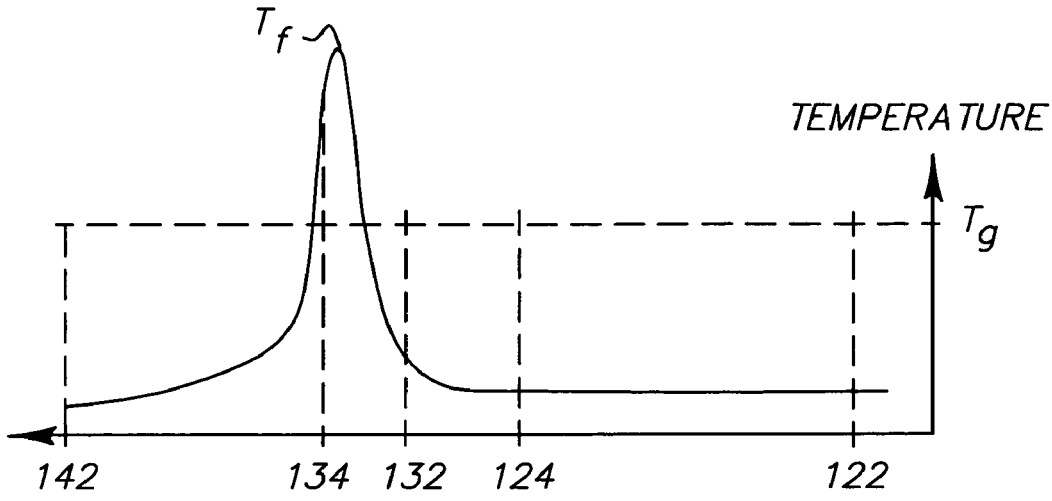
FIG. 2a (PRIOR ART)
FIG. 2A is a prior art graph showing the relationship of recording element temperature to recording element position in a prior art apparatus.

Referring to FIG. 2A and back to FIG. 1, a graph showing the relationship of recording element temperature to recording element position in a prior art apparatus, for example, a fuser of an electrophotographic device, is shown. As is known in electro-photography, energy from the heated fuser rollers 136, 138 is used to fix toner on recording element 114. Energy requirements are substantial because recording element 114 is not heated before entering the converting nip 150. As recording element 114 moves through converting nip 150 (from entrance 132 through exit 134), recording element 114 is heated well above the glass transition temperature $T_g$ (softening temperature) and pressed between rollers 136, 138. The fused imaged recording element 114 must be separated from rollers 136, 138. However, the ability of recording element 114 to separate (or release) is adversely affected because fused imaged recording element 114 is at a temperature well above its glass transition temperature $T_g$, as described above.

Commonly referred to as a hot release problem, in addition to using release agent(s) as described above, specialty roller material(s), for example those disclosed in U.S. Pat. Nos. 5,780,545, 5,678,154, and 5,824,416 are used to assist with the release of the fused imaged recording element 114. Additionally, devices such as mechanical skives and/or air skives are used to help separate the fused imaged recording element 114 from rollers 136, 138. In this sense, hot release refers to the release temperature $T_f$ of the fused imaged recording element 114 being higher than the fused imaged recording element 114 effective glass transition temperature $T_g$ of the recording element 114 at the exit 134 of converting nip 150.

Figure 2B:
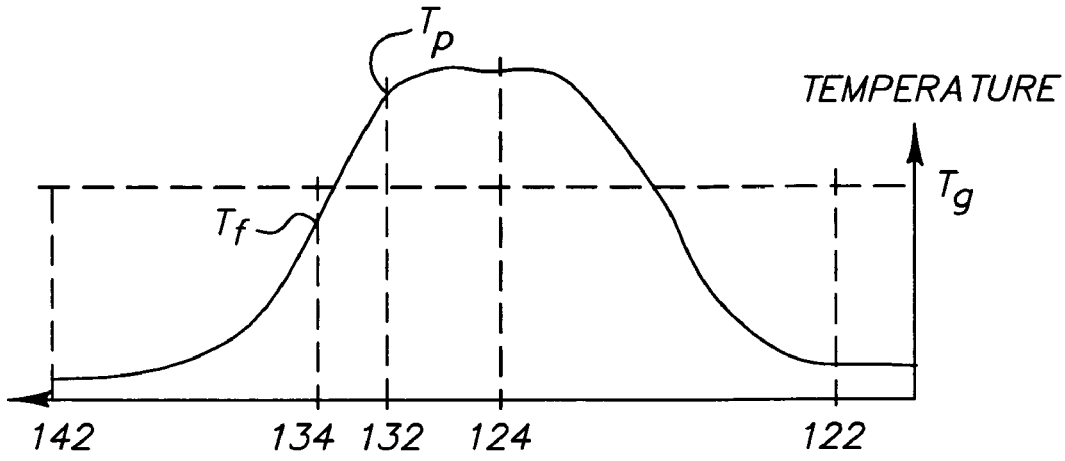
FIG. 2B is a graph showing the relationship of recording element temperature to recording element position in the apparatus of FIG. 1.

Referring to FIG. 2B and FIG. 1, a graph showing the relationship of recording element temperature to recording element position in the apparatus of FIG. 1 is shown. It is known that polymers exhibit a solid-like characteristic at a temperature below their glass transition temperature $T_g$. Recording element 114 is heated to a processing temperature $T_p$ that is higher than the effective glass transition temperature $T_g$ of the recording element 114 when it enters converting nip 150. Also, as recording element 114 enters converting nip 150 of converting station 24 at entrance 132, adequate nip pressure is applied to recording element 114 in order to convert a portion (one or more layers) of recording element 114 into a continuous, for example, protective, layer. During this process, energy present in recording element 114 conducts through converting rollers 136, 138. As such, the temperature of recording element 114 is lower at the exit 134 of converting nip 150 (as compared to the temperature of recording element 114 at the entrance 132) which helps converted recording element 114 to separate cleanly from rollers 136, 138 at exit 134.

Clean separation is enhanced because recording element 114 is cooled to a temperature $T_f$ where the protective layer portion exhibits a solid-like characteristic and adheres to the substrate portion of recording element 114. Cooling of recording element 114 is controlled by a first temperature $T_1$, with $T_1$ being at, or greater than, or less than ambient temperature of the one of rollers 136, 138 and a second temperature $T_2$, with $T_2$ being at, or greater than, or less than ambient temperature of the other of rollers 136, 138 of converting station 24. However, the specific release temperature used to achieve clean separation also depends on the effective glass transition temperature $T_g$ of recording element 114. When the release temperature $T_f$ of converted ink recording element is lower than its effective glass transition temperature $T_g$ at the exit 134 of converting station 24 is referred to as cold release. When more than one type of material is present in the convertible portion of recording element 114, the effective glass transition temperature $T_g$ of recording element 114 can be described in terms of the effective glass transition temperatures $T_g$, $T_{g1}$, $T_{g2}$, . . . . $T_{gn}$ of the materials present in the convertible layer.

A releasing agent can also be used with the recording element 114, preferably in the outermost layer, to help it release from rollers 136, 138. Examples of such releasing agents include: waxes, such as carnauba wax, paraffin wax, micro crystalline wax and castor wax; higher fatty acids or derivatives thereof like metal salts and esters; polyamide-based resins, petroleum-based resins, rosin derivatives, coumarone-indene resins, terpene-based resins, novolak-based resins, styrene-based resins, and olefin-based resins such as polyethylene, polypropylene, polybutene, oxidated polyolefins and vinyl ether-based resins.

As an imaged recording element 114 enters the carrier removal station 22, the operating environment of carrier removal station 22 is such that a sufficient amount of carrier is removed from recording element 114 while recording element 114 is heated to a processing temperature $T_p$ that exceeds the effective glass transition temperature $T_g$ of recording element 114 (or of the material(s) that comprise the convertible portion of recording element 114) when recording element 114 exits carrier removal station 22 at exit 124.

Recording element 114 enters converting station 24 and a portion of recording element 114 is converted by converting nip 150 to form a continuous layer. One of rollers 136, 138 is maintained at a first temperature $T_1$ while the other of rollers 136, 138 is maintained at a second temperature $T_2$, with $T_1$ being less than $T_p$ and $T_2$ being less than $T_p$. In order to achieve uniform pressure across the width of recording element 114 and provide adequate dwell time in converting nip 150, at least one of rollers 136, 138 can have an elastomeric cover. At the exit of converting station 134, the converted recording element has a temperature $T_f$, with $T_f$ being less than $T_p$ and more preferably the $T_f$ being less than the effective glass transition temperature $T_g$ of recording element 114.

Figure 3:
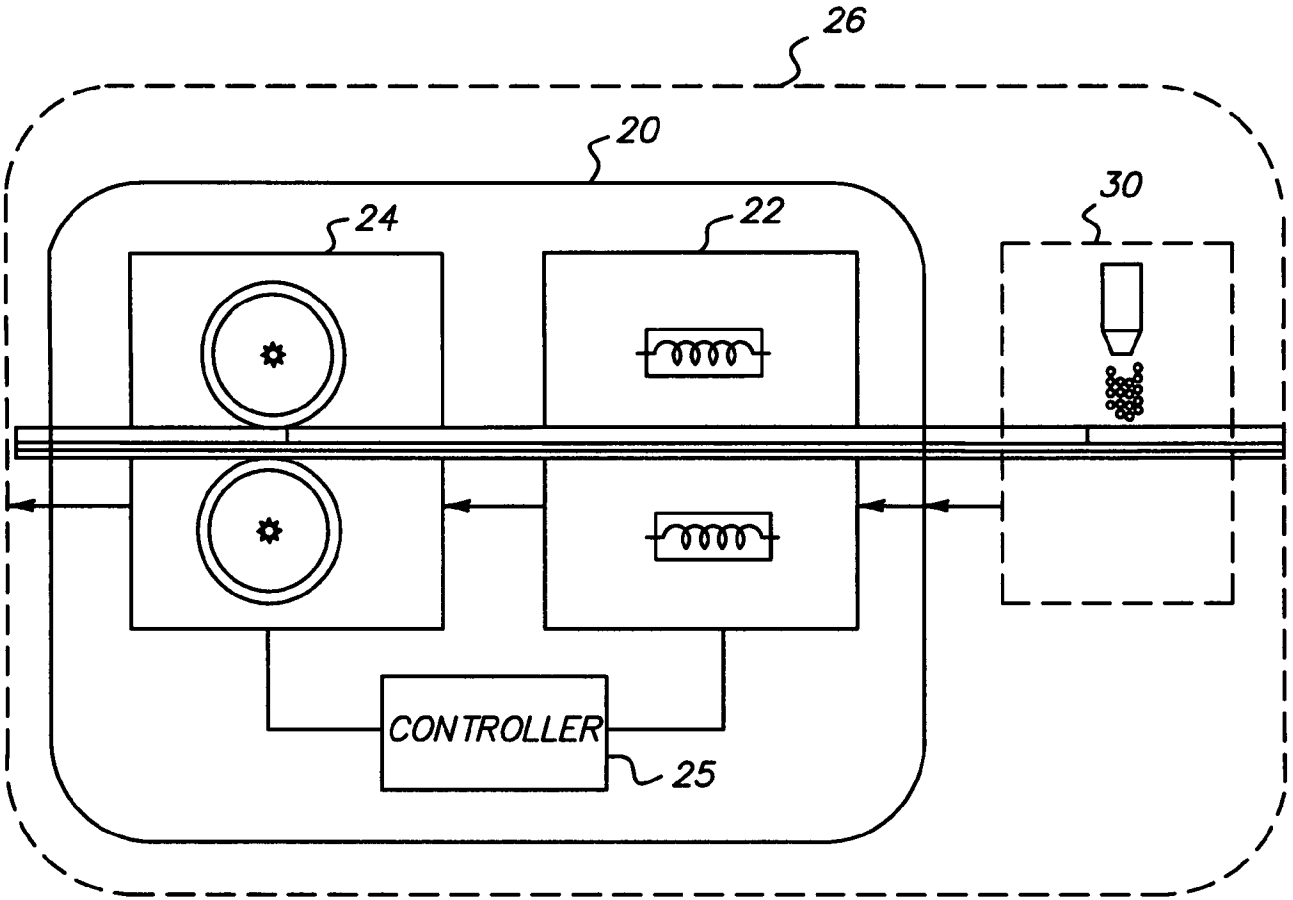
FIG. 3 is a block diagram of an alternative embodiment of an apparatus made in accordance with the invention.

Referring to FIG. 3, Apparatus 20 can be incorporated into a conventional printing system 26. In this context, conventional printing systems include any printing system that deposits one or more inks onto and/or into a recording element, for example, an inkjet printing system, etc. The embodiments discussed below are done so in the context of an inkjet printing system 26. However, any type of printing system 26 that deposits a liquid, for example, a colorant having a carrier can be used with apparatus 20. When incorporated into printing system 26, controller 25 can also be incorporated into system 26 and/or included in addition to any printing system controllers.

Typically, an inkjet printing system 26 includes one or more printheads, recording element conveying systems, controllers, user interfaces, etc. (shown generally using 30). Inkjet printing system 26 can include a drop-on-demand type printer employing a piezoelectric printhead or a thermal printhead. Alternatively, system 26 can include a continuous type printer. Ink drop formation can be accomplished using any conventional technique.

Any conventional inkjet ink can be deposited on and/or in the recording element using inkjet printing system 26. Typical inkjet inks are either aqueous-based or solvent-based and include mostly carrier and a small amount of pigment and/or dye colorant. For aqueous-based inks, water and water-miscible humectants and co-solvents such as polyhydric alcohols such as diethylene glycol or glycerol are the carrier. Solvent-based inks contain one or more organic solvents as the carrier; for example, alcohols such as methanol, ethanol, propanol, iso-propanol; ketones such as acetone, methyl ethyl ketone, methyl isobutyl ketone, cyclohexanone and 4-methoxy-4-methylpentanone; hydrocarbons such as cyclohexane, methylcyclohexane, n-pentane, n-hexane and n-heptane; esters such as ethyl acetate and n-propyl acetate; dimethyl sulfoxide; n-methyl-2-pyrrolidone; γ-butyrolactone; toluene; xylene and high-boiling petroleums. The choice of carrier is not particularly limited, as long as it can be removed by the carrier removal station 22 without causing deformation or deterioration of the recording element or the image printed thereon.

In one embodiment, aqueous-based inks are used with the invention to generate inkjet prints. Examples of aqueous-based inkjet inks include any inkjet ink commercially available from, for example, Canon, U.S.A., Inc.; Epson America, Inc.; Hewlett-Packard Co.; Eastman Kodak Co.; etc.

Pigment or dye colorant components of inks used with inkjet printing system 26 have either chromatic color such as cyan, magenta, yellow, orange, green, or violet, or they can have achromatic color such as black, white, gray or colorless. In certain imaging applications, inks having the same hue but different densities are employed. For example, an inkjet printer designed for rendering medical images typically employs a set of black inks, wherein each ink in the set has the same hue but a different density in order to generate high-quality multilevel grayscale images.

Pigment colorants useful in the inks that can be employed in inkjet printing system 26 include any known pigment, or combination of pigments, commonly used in the art of inkjet printing. Such pigments include azo pigments, naphthol pigments, benzimidazolone pigments, metal complex pigments, phthalocyanine pigments, quinacridone pigments, perylene and perinone pigments, anthrapyrimidone pigments, flavanthrone pigments, anthanthrone pigments, dioxazine pigments, titanium oxide, iron oxide, carbon black and the like. Preferred pigments are C.I. Pigment Blue 15:3; the bridged aluminum phthalocyanine pigment described in U.S. Pat. No. 5,738,716; C.I. Pigment Red 122; C.I. Pigment Yellow 155; C.I. Pigment Yellow 74; C.I Pigment Yellow 97; C.I Pigment Yellow 128 or C.I. Pigment Black 7, because combinations of these pigments tend to provide the best color. The exact choice of pigment will depend upon the specific application and performance requirements such as color reproduction and image stability.

Pigment colorants useful in the inks that can be employed in inkjet printing system 26 generally have average particle sizes of less than about 500 nm. Preferably, the average particle size is less than 200 nm, and especially less than 90 nm, because inks formulated with pigments having these particle sizes tend to jet reliably. For aqueous-based inks containing pigment colorants, a dispersant is typically used to stabilize the pigment particles against flocculation and settling. Dispersants are typically used to mill the pigment particles to an appropriate size, as described, for example, in U.S. Pat. Nos. 5,679,138; 5,085,698 and 5,172,133 and are added to the ink as part of the pigment itself. Dispersants may also be added separately from the pigment. Self-dispersing pigments may also be used; these types of pigments are inherently stable against flocculation and settling and do not require a dispersant.

Dye colorants useful in the inks that can be employed in inkjet printing system 26 include any known dye, or combination of dyes, commonly used in the art of inkjet printing. Such dyes include water-soluble reactive dyes, direct dyes, anionic dyes, cationic dyes, acid dyes, food dyes, metal-complex dyes, phthalocyanine dyes, anthraquinone dyes, anthrapyridone dyes, azo dyes, rhodamine dyes, and the like. Typical examples of dyes include C.I. Direct Yellow 86, 107, 132, 173; Acid Yellow 17 and 23; C.I. Reactive Red 23, 24, 31, 120, 180, 241; Acid Red 35, 52, 249, 289, 388; Direct Red 227; CAS No. 224628-70-0 sold as JPD Magenta EK-1 Liquid from Nippon Kayaku Kabushiki Kaisha; CAS No. 153204-88-7 sold as Intrajet® Magenta KRP from Crompton and Knowles Colors; the metal azo dyes disclosed in U.S. Pat. Nos. 5,997,622 and 6,001,161; C.I. Direct Blue 86, 199, 307; Acid Blue 9; Reactive Black 31; Direct Black 19, 154, 168; Food Black 2; Fast Black 2, Solubilized Sulfur Black 1 (Duasyn® Black SU-SF). The exact choice of dye will depend upon the specific application and performance requirements such as color reproduction and image stability.

Humectants, co-solvents, surfactants, defoamers, buffering agents, chelating agents, and conductivity-enhancing agents are usually employed in inkjet inks for a variety of reasons, most of which are dictated by the requirements of the printhead from which they are printed. Thermal and piezoelectric drop-on-demand printheads and continuous printheads each require inks with a different set of physical properties in order to achieve reliable and accurate jetting of the ink, as is well known in the art of inkjet printing. Humectants, co-solvents and surfactants are also used to prevent the inks from drying out or crusting in the orifices of the printhead, aid solubility of the components in the ink, and facilitate penetration of the ink into the recording medium after printing. A typical aqueous-based ink useful in the inkjet printing system 26 may contain, for example, the following components based on the total weight of the ink: colorant 0.05–10%, water 20–95%, humectant(s) 5–70%, co-solvent(s) 2–20%, surfactant(s) 0.02–10%, and biocide (s) 0.05–5%, and have a pH of 2–10.

Although the inks described above are conventional inkjet inks, any fluid that can be jetted using an inkjet printer can be used in inkjet printing system 26, as long as the fluid includes a carrier that can be removed by the carrier removal station without causing deformation or deterioration of the recording element itself or the image printed thereon. Other examples of fluids that can be used in inkjet printing system 26 include radiation-curable inks, and colorless inks containing fragrance agents, flavoring agents, or compounds that are used to provide security features such as near-infrared fluorescent compounds, UV-absorbing compounds, and the like.

Any recording element 114 can be used with apparatus 20 provided the recording element is capable of absorbing ink and undergoing a durability characteristic change or alteration. Again, durability characteristics include, but are not limited to, resistance to water, stains, light, ozone, scratches, rubbing, etc. The recording element typically includes a support having at least one ink-receiving layer coated thereon. For recording element(s) 114 having a single ink-receiving layer coated on a support, the layer should be of the type that initially allows absorption of the ink, and then permits at least some of carrier (for example, some of the water) to be removed from it, and at least a portion of the layer should be of the type that a durability characteristic of the recording element can be increased.

Recording element(s) 114 that can be used with apparatus 20 may also include a plurality of ink-receiving layers wherein the layers provide the same or different functions. For example, one layer may be used to trap dye or pigment colorant, and another layer may be used to trap any of the other ink components including carrier. The layers may be in any order on the support, as long as the uppermost layer (the layer that first receives ink) is of the type that a durability characteristic of the recording element as a whole is capable of being increased. Durability characteristics of the other layers may also be changed, preferably increased, as long as the uppermost layer can be converted to increase a durability characteristic of the recording element as a whole. The layers should be optimized relative to one another such that the recording element as a whole initially allows absorption of the ink, and then permits at least some of the carrier to be removed from at least one of the layers and from the recording element as a whole.

In one embodiment of the invention, recording element 114 has a porous convertible layer(s) coated on a porous support. The porous convertible layer (with the porous portion being present for ink absorption and the convertible portion being present to be worked on by heat and pressure to form a continuous polymeric film to provide, for example, image protection) includes polymeric particles and polymeric binders. The polymeric particles have a glass transition temperature $T_{g1}$, with the glass transition temperature $T_{g1}$ of the polymeric particles being from 40° C. to 140° C. More preferably, the glass transition temperature $T_{g1}$ of the polymeric particles is from 55° C. to 95° C. The polymeric binder has a glass transition temperature $T_{g2}$, with the glass transition temperature $T_{g1}$ of the polymeric particles being from −30° C. to 95° C. More preferably, the glass transition temperature $T_{g1}$ of the polymeric particles is from 0° C. to 55° C. After printing, heating station 22 removes an amount of carrier from the recording element as a whole while the colorant portion of the ink is trapped in the single layer before (and after) a durability characteristic of the layer has been increased. At least some of any remaining carrier, including, for example, humectants, co-solvents, and water can evaporate from the recording element through the porous support over time after a durability characteristic has been increased. The exit temperature $T_f$ of the recording element from the converting station is less than the glass transition temperature $T_{g1}$ of the polymeric particles.

In another embodiment of the invention, the recording element has a porous convertible layer(s) coated on a nonporous-support. The porous convertible layer has pores located between the polymeric particles. Converting the heated convertible layer of the recording element by advancing the recording element through the pair of rollers removes substantially all of the pores located between the polymeric particles of the convertible layer. Advancing the recording element through the pair of rollers includes applying pressure to the recording element with the pressure being from about 0.5 kg/cm$^2$ to about 25.0 kg/cm$^2$. More preferably, the pressure applied as the recording element travels through the pair of rollers is from about 1.8 kg/cm$^2$ to about 17.6 kg/cm$^2$.

The overall image quality of the converted recording element is also dependent on the smoothness of the surface. One commonly used measurement to quantify the converted surface is the specular gloss, described above, that is associated with the capability of a surface to reflect light in a prescribed angle. The converted layer of the recording element has a 20° specular gloss greater than about 20, and more preferably has a 20° specular gloss greater than about 60. Additionally, it is preferable that the converted layer has a percent transmittance no less than about 75 after conversion.

The convertible layer also has an original (pre-conversion) thickness. Converting the convertible layer of the recording element by advancing the recording element through the pair of rollers also reduces the original thickness of the layer from 5% to 50%, and more preferably, reduces the original thickness of the layer from 15% to 40%.

In another embodiment of the invention, recording element 114 has two layers, an uppermost layer coated on an underlying layer that is coated directly on a nonporous or porous support. The uppermost layer traps the colorant and both layers absorb the remainder of the ink. Both layers function together such that carrier removal station 22 removes carrier from recording element 114 before a durability characteristic of the recording element is increased. Any remaining carrier is trapped in the underlying layer. One or both of the layers, preferably at least the uppermost layer, are converted by converting station 24 such that a durability characteristic of the recording element as a whole is increased.

Examples of suitable recording elements include those described in U.S. Pat. No. 6,497,480 B1 issued to Wexler on Dec. 24, 2002; U.S. Pat. No. 6,475,603 B1 issued to Wexler on Nov. 5, 2002; and U.S. Pat. No. 6,399,156 B1 issued to Wexler et al. on Jun. 4, 2002; and U.S. application Ser. Nos. 10/289,862 of Yau et al. filed Nov. 7, 2002; Ser. No. 10/260,665 and 10/260,663 both of Wexler et al. filed Sep. 30, 2002; and Ser. No. 10/011,427 of Yau et al. filed Dec. 4, 2001.

Additional examples of suitable recording elements include any recording element known in the industry as being fusible or convertible, or any recording element that utilizes the incorporated approach, as described above. Other suitable recording element examples include those described in U.S. Pat. No. 5,374,475, issued to Walchli, on Dec. 20, 1994; U.S. Pat. No. 6,357,871 B1, issued to Ashida et al., on Mar. 19, 2002; U.S. Patent Applications 2002/0008747 A1; 2002/0048655 A1; European Patent Application 1,078,775 A2; Japanese Unexamined Patent Publication No. 01-182081, in the name of Akitani et al.

The size of the recording element can be any size appropriate for its intended use. For example, the recording element can be used as labels or tape and have a width of less than 0.25 cm (0.1 in) and any length. Alternatively, the recording medium can be used as signage and have a width of over 183 cm (72 in). The recording element can be of the type used in the medical imaging industry and have dimensions of 35.6 cm by 43.2 cm (14 in by 17 in). Or, the recording element can have dimensions typically associated with photographic images of various sizes, for example, 8.89 cm×12.7 cm (3.5×5 inch format); 10.16 cm×15.24 cm (4×6 inch format); 20.32 cm×25.4 cm (8×10 inch format); etc.

Figure 4:
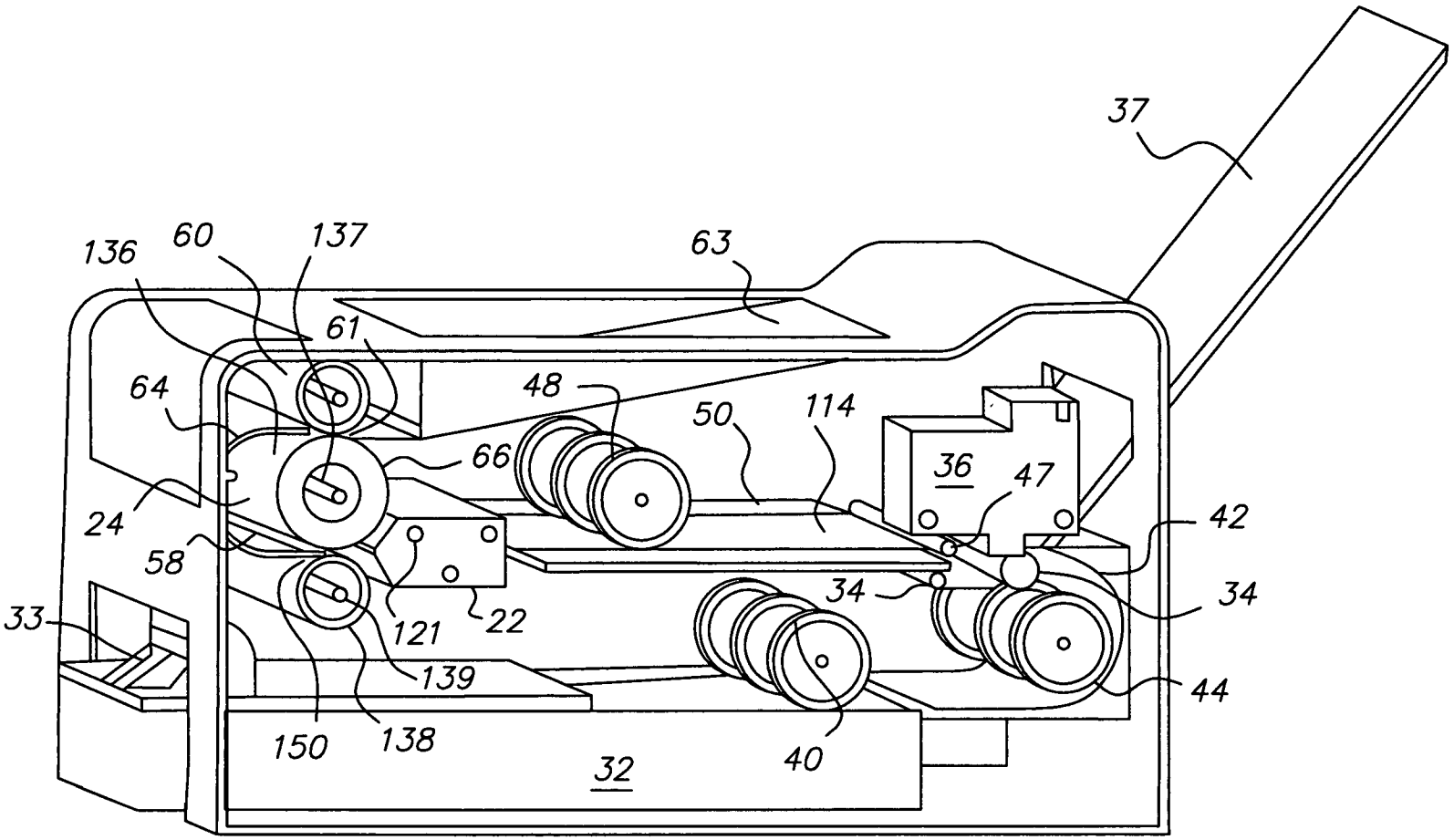
FIG. 4 is a schematic perspective view of an example embodiment of an apparatus made in accordance with the invention.

Referring to FIG. 4, an example embodiment of recording element treating apparatus 20 is shown incorporated into inkjet printing system 26. Inkjet printing system 26 includes a removable recording element supply tray 32, a recording element conveying system (shown generally using 34), and a printhead 36. Supply tray 32 can be replenished with recording element 114 by removing supply tray 32 from printing system 26 using a handle 33, filling supply tray 32 with additional recording element 114, and reinserting supply tray 32 into printing system 26. Printing system 26 can also include an auxiliary recording element feed supply 37. In alternative embodiments, printing system 26 can include any number of components known in the industry.

During operation, recording element 114 is caused to move from supply tray 32 by recording element picking wheels 40 and caused to travel through a recording element supply chute 42 by recording element urging wheels 44. After exiting supply chute 42, an image and/or text is printed on recording element 38 by printhead 36 (included in a printing station). Conveying system 34 including one or more driven pinch wheels 47 moves recording element 114 through printing station 46. Intermediate transport wheels 48 move printed recording element 114 over a transport platform 50 toward treating apparatus 20.

Treating apparatus 20 includes a carrier removal station 22 which includes a device(s) 121 that removes carrier and heats recording element 114 to a treating temperature above the effective glass transition temperature $T_g$ of recording element 114. In the embodiment shown in FIG. 2, device 121 includes one or more non-contact types of heating devices or elements 123 such as halogen lamps, infrared lamps and hot-air heater that produce energy to evaporate or remove ink carrier from recording element 114 and heat recording element 114.

Recording element 114 enters converting station 24 by passing through pressure roller 138 and driving pressure roller 136 which form a converting nip 150. The relative positions of roller 138 and roller 136 are such that the pressure created and applied to recording element 114 by roller 138 and roller 136 is sufficient to increase a durability characteristic of recording element 114 as recording element 114 travels through roller 136 and roller 138. After exiting converting nip 150, recording element 144 travels around an inverter chute 58.

Recording element 114 then passes through a transport roller 60 and roller 136 which form a transport nip 61. The relative positions of roller 60 and roller 136 are such that the pressure created and applied to recording element 114 by roller 60 and roller 136 is sufficient to move recording element 114 without significantly altering a flatness of recording element 114. Flatness is referred to the curl of the recording element 114. Recording element 114 exits treating apparatus 20 coming to rest in an exit tray 63.

Roller 136 and/or roller 138 can be hollow and include a heating element 137 and/or 139 (for example, a halogen lamp, etc.) that elevates the temperature of the converting station 24 and helps with the durability characteristic change. Temperature sensor 64 (connected to a temperature control device, for example, controller 25 of apparatus 20), can be included in the converting station 24 to monitor temperature inside the converting station 24. Although an exit temperature $T_f$ of the recording element is at least partially controlled by converting station 24, the exit temperature $T_f$ is preferred to be less than the glass transition temperature $T_{g1}$ of the polymeric particles, described above, for better release performance of converted imaged recording element.

Printing system 26, shown in FIG. 4, has a "S" shaped recording element 114 travel path where portions of the travel path overlap other portions of the travel path, either vertically (as shown in FIG. 4) or horizontally, as the travel path is followed from start to finish or vice versa. This facilitates a reduced printing system 26 footprint such that printing system 26 can be a "desktop" type printer or a mid-format type printer that can easily fit onto a desktop.

Although the embodiment shown in FIG. 4 has an "S" shaped travel path, it is recognized that other travel path configurations can facilitate a desktop type printing system 26. For example, in FIG. 5, another embodiment of apparatus 20 is shown which incorporates a travel path that is not curved in the region of apparatus 20.

Figure 5:
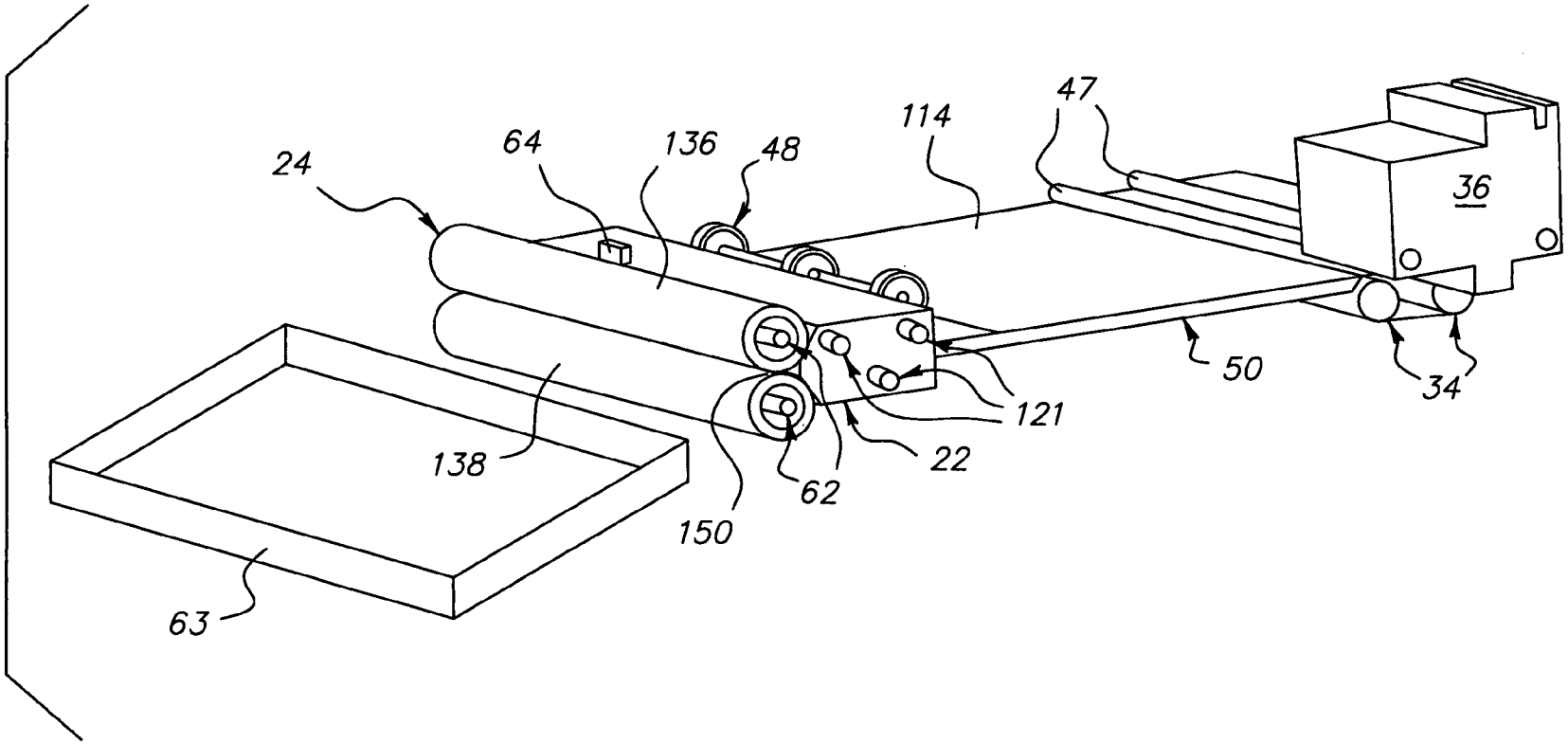
FIG. 5 is a schematic perspective view of another example embodiment of an apparatus made in accordance with the invention.

Referring to FIG. 5, in this embodiment, recording element 114 travels through carrier removal station 22 which includes one or more non-contact types of heating devices 121 such as halogen lamps, infrared lamps and hot-air heater that heat recording element 114 to a converting temperature as described above with reference to FIG. 4. In this embodiment, carrier removal station 22 also produce energy to evaporate or remove ink carrier from recording element 114 as recording element 114 moves toward converting station 24 using device(s) 121. This prepares recording element 114 for entry into converting station 24 by removing ink carrier in recording element 114 which can decrease the likelihood of image defects such as blisters and can increase the speed at which rollers 138 and 136 are operated. In addition, this minimizes the image defects and increases productivity (thru-put) in apparatus 20.

Recording element 114 enters converting station 24 by passing through a pressure roller 138 and a driving pressure roller 136 which form a converting nip 150. The relative positions of roller 138 and roller 136 are such that the pressure created and applied to recording element 114 by roller 138 and roller 136 is sufficient to increase a durability characteristic of recording element 114 as recording element 114 travels through roller 138 and roller 136. Recording element 114 exits treating apparatus 20 coming to rest in exit tray 63.

Roller 138 and/or roller 136 can also be hollow and include heating element 62 (for example, a halogen lamp, etc.) that elevates the temperature of the converting station 24 and assists with the durability characteristic change. Temperature sensor 64 (connected to a temperature control device, for example, controller 25 of apparatus 20), can be included in the converting station 24 to monitor temperature inside the converting station 24.

Figure 6:
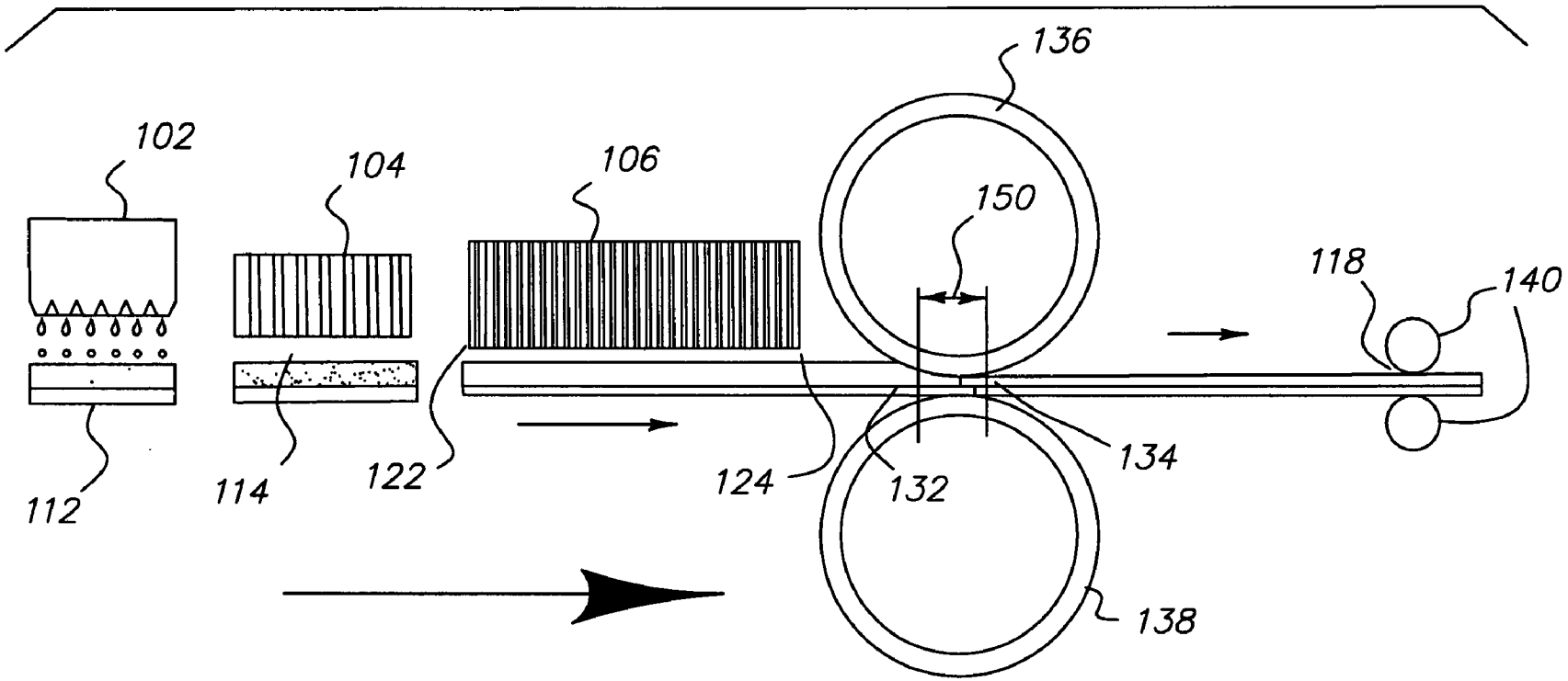
FIG. 6 is a schematic side view of an example embodiment of a portion of an apparatus made in accordance with the invention.

Referring to FIG. 6, an alternative embodiment according to the invention for forming a durable image using a pre-heating step and an unheated, cold-release pressure nip is shown. The imaged recording element 114 travels through carrier removal station 22 which includes one or more non-contact types of heating devices 121 such as halogen lamps, infrared lamps and hot-air heater that heat recording element 114 to a converting temperature well above the glass transition temperature of recording element 114. Recording element 114 enters converting station 24 by passing through a unheated converting nip 150 that comprising a unheated pressure roller 138 and a unheated driving pressure roller 136.

The temperature of the recording element before entering the converting nip 150 is set such that even the recording element is cooled through the converting nip, the recording element 114 is still compliant enough to be converted by the pressure created by the unheated roller 138 and roller 136 to increase a durability characteristic of recording element 114. In this embodiment, the unheated converting nip 150 takes away energy from recording element 114 as recording element 114 moves through converting station 24. The temperature of the recording element 114 at the exit of the converting nip 134 can be lower than the glass transition temperature of the recording element 114 which means that the recording element 114 is in a solid-like state that can decrease the likelihood of recording element 114 sticking on the unheated pressure roller 138.

Figure 7:
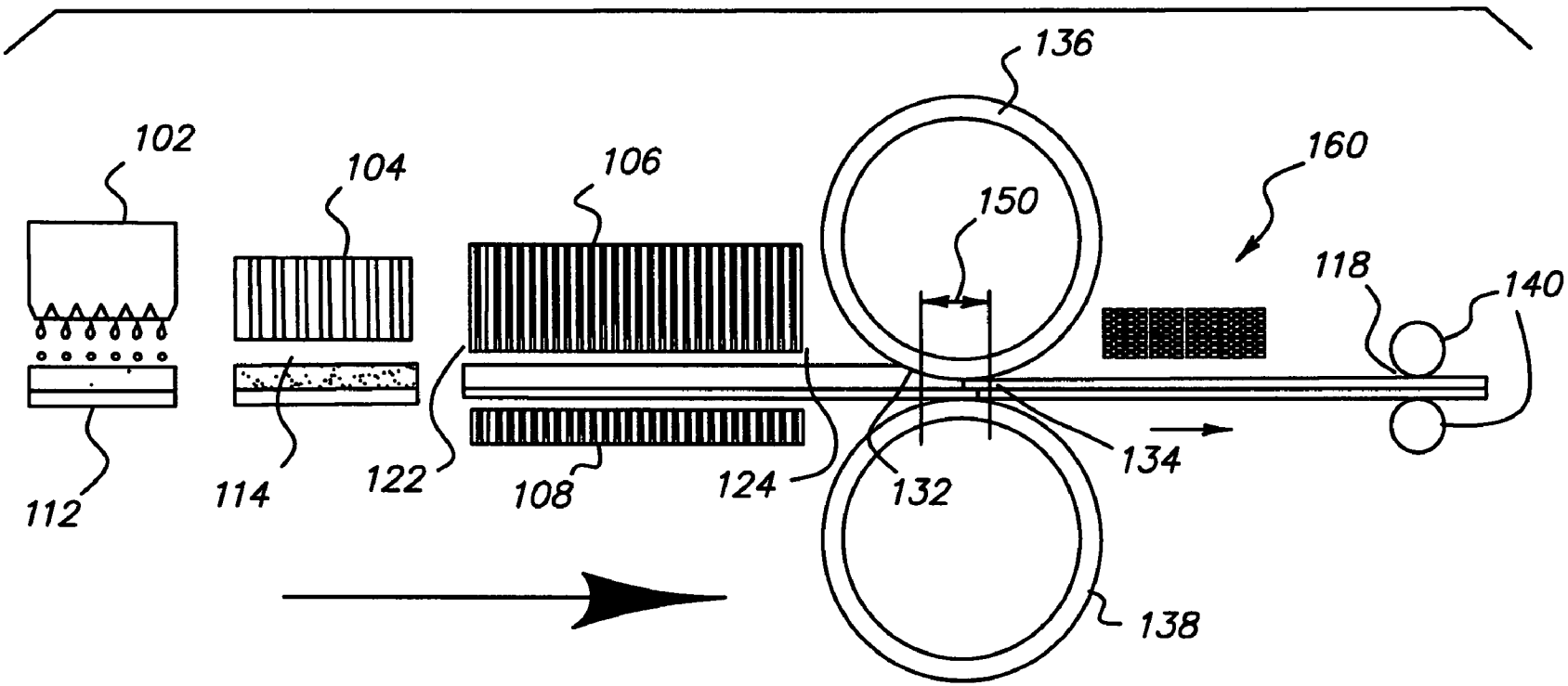
FIG. 7 is a schematic side view of another example embodiment of a portion of an apparatus made in accordance with the invention.

Referring to FIG. 7, an alternative embodiment according to the invention for forming a durable image using a pre-heating step and an unheated, cold-release pressure nip, and a forced cooling step right after the media exiting the converting nip is shown. The imaged recording element 114 travels through carrier removal station 22 which includes one or more non-contact types of heating devices 121 such as halogen lamps, infrared lamps and hot-air heater that heat recording element 114 to a converting temperature well above the glass transition temperature of recording element 114. Recording element 114 enters converting station 24 by passing through a converting nip 150 that comprising a pressure roller 138 and a driving pressure roller 136. Roller 136 and/or roller 138 can be hollow and can include a heating element 137 and/or 139 (for example, a halogen lamp, etc.) as described above with reference to FIG. 1 and FIG. 6. The temperature of the recording element before entering the converting nip 150 is set such that even the recording element is cooled through the converting nip, the recording element 114 is still compliant enough to be converted by the pressure created by the unheated roller 138 and roller 136 to increase a durability characteristic of recording element 114. In this embodiment, the unheated converting nip 150 takes away energy from recording element 114 as recording element 114 moves through converting station 24. The temperature of the recording element 114 at the exit of the converting nip 134 can be lower than the glass transition temperature of the recording element 114 which means that the recording element 114 is in a solid-like state that can decrease the likelihood of recording element 114 sticking on the unheated pressure roller 138. In this embodiment, a cooling and release apparatus 160 such as non-contact air-skive is added to help releasing the said converted recording element from the converting nip and at the same time to cool down the converted recording element for downstream handling. To save footprint of the apparatus, the converted recording element may be transported through a U-shaped guide. It is well known that transporting a converted recording element at elevated temperature through a curved guide may cause unwanted curl set. Therefore, it is important that the temperature of the recording element 114 after exiting the converting nip 134 is further reduced to well below the glass transition temperature by the said cooling and release apparatus 150 before entering the curved guide.

The invention has been described in detail with particular reference to certain preferred embodiments thereof, but it will be understood that variations and modifications can be effected within the scope of the invention.

The invention claimed is:

1. A method of converting a recording element comprising:

providing an imaged recording element having a convertible layer, the convertible layer comprising polymeric particles and a polymeric binder, the polymeric particles having a glass transition temperature $T_{g1}$, and the polymeric binder having a glass transition temperature $T_{g2}$;

heating the convertible layer to a temperature $T_p$, $T_p$ being greater than $T_{g1}$ and $T_{g2}$; and converting the heated convertible layer of the recording element by advancing the recording element through a pair of rollers, the first roller of the pair of rollers being maintained at a first temperature $T_1$ and the second roller of the pair of rollers being maintained at a second temperature $T_2$, $T_1$ and $T_2$ being less than $T_p$, the convertible layer of the recording element becoming a converted layer after advancing through the pair of rollers, wherein the converted layer has an exit temperature $T_f$, $T_f$ being less than $T_p$.

2. The method according to claim 1, wherein the glass transition temperature $T_{g1}$ of the polymeric particles is from 40° C. to 140° C.

3. The method according to claim 1, wherein the glass transition temperature $T_{g1}$ of the polymeric particles is from 55° C. to 95° C.

4. The method according to claim 1, wherein the glass transition temperature $T_{g2}$ of the polymeric binder is from −30° C. to 95° C.

5. The method according to claim 1, wherein the glass transition temperature $T_{g2}$ of the polymeric binder is from 0° C. to 55° C.

6. The method according to claim 1, the convertible layer including pores located between the polymeric particles, wherein converting the heated convertible layer of the recording element by advancing the recording element through the pair of rollers includes removing substantially all of the pores located between the polymeric particles of the convertible layer.

7. The method according to claim 6, wherein advancing the recording element through the pair of rollers includes applying pressure to the recording element, the pressure being from about 1.8 kg/cm to about 17.6 kg/cm$^2$.

8. The method according to claim 6, wherein advancing the recording element through the pair of rollers includes applying pressure to the recording element, the pressure being from about 0.5 kg/cm$^2$ to about 25.0 kg/cm$^2$.

9. The method according to claim 1, wherein $T_1$ is at ambient temperature.

10. The method according to claim 1, wherein $T_1$ is greater than ambient temperature.

11. The method according to claim 1, wherein $T_2$ is at ambient temperature.

12. The method according to claim 1, wherein $T_2$ is greater than ambient temperature.

13. The method according to claim 1, wherein $T_1$ is lower than ambient temperature.

14. The method according to claim 1, wherein $T_2$ is lower than ambient temperature.

15. The method according to claim 1, wherein the converted layer of the recording element has a 20° specular gloss greater than about 20.

16. The method according to claim 1, wherein the converted layer of the recording element has a 20° specular gloss greater than about 60.

17. The method according to claim 1, wherein the recording element has a percent transmittance no less than about 75 after the convertible layer has been converted.

18. The method according to claim 1, the imaged recording element including a printed side, wherein heating the convertible layer includes applying heat to the printed side of the recording element.

19. The method according to claim 1, the imaged recording element including a printed side and a support, wherein heating the convertible layer includes applying heat to the printed side of the recording element and applying heat to the support of the recording element.

20. The method according to claim 1, the convertible layer having an original thickness, wherein converting the heated convertible layer of the recording element by advancing the recording element through the pair of rollers includes reducing the original thickness of the convertible layer from 5% to 50%.

21. The method according to claim 1, the convertible layer having an original thickness, wherein converting the heated convertible layer of the recording element by advancing the recording element through the pair of rollers includes reducing the original thickness of the convertible layer from 15% to 40%.

22. The method according to claim 1, wherein the exit temperature $T_f$ is less than the glass transition temperature $T_{g1}$ of the polymeric particles.

* * * * *